US008884728B2

(12) United States Patent
Jang

(10) Patent No.: US 8,884,728 B2
(45) Date of Patent: Nov. 11, 2014

(54) STATIONARY CONTACT ARM ASSEMBLY FOR MOLDED CASE CIRCUIT BREAKER

(71) Applicant: LSIS Co., Ltd., Anyang-si (KR)

(72) Inventor: Jun Yong Jang, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 14/017,912

(22) Filed: Sep. 4, 2013

(65) Prior Publication Data

US 2014/0070908 A1 Mar. 13, 2014

(30) Foreign Application Priority Data

Sep. 11, 2012 (KR) ..... 10-2012-0100610

(51) Int. Cl.

| | |
|---|---|
| ***H01H 9/30*** | (2006.01) |
| ***H01H 71/02*** | (2006.01) |
| ***H01H 3/00*** | (2006.01) |
| *H01H 71/24* | (2006.01) |

(52) U.S. Cl.

CPC ..... *H01H 3/00* (2013.01); *H01H 71/0207* (2013.01); *H01H 71/2409* (2013.01); *H01H 2071/0242* (2013.01)

USPC ..... 335/201; 335/6

(58) Field of Classification Search

USPC ..... 335/201

See application file for complete search history.

(56) References Cited

U.S. PATENT DOCUMENTS

| | | | | |
|---|---|---|---|---|
| 4,622,530 | A * | 11/1986 | Ciarcia et al. | 335/167 |
| 4,654,491 | A * | 3/1987 | Maier et al. | 218/33 |
| 4,698,903 | A * | 10/1987 | Ciarcia et al. | 29/622 |
| 5,268,661 | A * | 12/1993 | Grunert et al. | 335/16 |
| 5,589,672 | A * | 12/1996 | Uchida et al. | 218/34 |
| 6,300,586 | B1 * | 10/2001 | Doughty et al. | 218/148 |
| 7,358,840 | B1 * | 4/2008 | Shea et al. | 335/201 |
| 7,488,915 | B2 * | 2/2009 | Pollitt et al. | 218/149 |
| 8,334,740 | B2 * | 12/2012 | Annis et al. | 335/201 |
| 2008/0079519 | A1 * | 4/2008 | Shea et al. | 335/201 |

* cited by examiner

*Primary Examiner* — Elvin G Enad
*Assistant Examiner* — Lisa Homza
(74) *Attorney, Agent, or Firm* — Lee, Hong, Degerman, Kang & Waimey

(57) ABSTRACT

A stationary contact arm assembly for a molded case circuit breaker includes a stationary contact arm having a terminal portion and a contact portion provided at both end portions thereof in the length direction, and an inclined extension portion provided between the contact portion and the terminal portion, a flat extension portion forming a space between the flat extension portion and a bottom surface of the contact portion, a bent portion formed from the flat extension portion to the terminal portion; a magnet assembly having a plurality of steel plates at least part of which is installed to be pushed into a space between the flat extension portion and contact portion in the stationary contact arm; and an elastic support plate having an elastic support portion installed on the flat extension portion of the stationary contact arm to support the magnet assembly.

8 Claims, 2 Drawing Sheets

STATIONARY CONTACT ARM ASSEMBLY FOR MOLDED CASE CIRCUIT BREAKER

CROSS-REFERENCE TO RELATED APPLICATIONS

Pursuant to 35 U.S.C. §119(a), this application claims the benefit of earlier date and right of priority to Korean Patent Application No. 10-2012-0100610, filed on Sep. 11, 2012, the contents of which is incorporated by reference herein in its entirety.

BACKGROUND OF THE INVENTION

1. Field of the Invention

The present disclosure relates to a molded case circuit breaker, and more particularly, to a stationary contact arm assembly for a molded case circuit breaker.

2. Description of the related art

A molded case circuit breaker is a power device having a protective function to switch a relatively low voltage power circuit under several hundred volts or trip a circuit when a fault current such as an over current or short-circuit current occurs on the circuit.

As is well known, a molded case circuit breaker may include a stationary contact arm, a movable contact arm having a closed position formed to be brought into contact with the stationary contact arm and an open position formed to be separated from the stationary contact arm so as to break an electrical circuit, a switching mechanism configured to provide a driving force for driving the movable contact arm to a closed or open position, a trip mechanism configured to sense a fault current when it occurs on the circuit so as to trigger the operation of the switching mechanism to the open position, an extinguishing mechanism installed around the movable contact arm and stationary contact arm to extinguish an arc occurring during the open position operation, an enclosure for accommodating the constituent elements, namely, an upper cover and a lower case, and the like.

The molded case circuit breaker may also include a molded case circuit breaker with a current limiting function for automatically limiting a fault current using an electromagnetic repulsive force generated between the contacts of the stationary contact arm and movable contact arm when the fault current occurs, and a molded case circuit breaker without the current liming function.

In order to perform such a current limiting function, the stationary contact arm should be a current limiting type stationary contact arm, and the current limiting type stationary contact arm with a terminal portion and a contact portion formed at both ends thereof has a laid down U-shaped geometric feature in which the contact portion is bent toward the side of the terminal portion.

Owing to the geometric feature, the direction of a current flowing into the contact portion and direction of a current flowing out of the contact portion are opposite to each other, and thus a magnetic field formed around the flowing-in current and flowing-out current are repulsive to each other, and in particular when a current flowing through the circuit is abnormally large, the corresponding magnetic repulsive force becomes large to the extent that the movable contact arm is pushed out in the direction of being separated from the stationary contact arm.

The present disclosure relates to the current limiting type stationary contact arm assembly in which the movable contact arm is separated from the stationary contact arm using a magnetic repulsive force, thereby automatically limiting an abnormal current on an electric circuit.

For such a current limiting type stationary contact arm assembly, there has been disclosed a technology in which a magnet assembly formed with a plurality of steel plates is attached to the stationary contact arm to more greatly generate an electromagnetic repulsive force for the current limiting function, thereby enhancing the magnetic permeability of the stationary contact arm.

However, during the switching operation between the movable contact arm and stationary contact arm of the molded case circuit breaker or subsequent to the current limiting operation, it is required to maintain the position of the magnet assembly formed with a plurality of steel plates in a stationary manner even with repeated shocks while the movable contact arm is returned again to a position in contact with the stationary contact arm.

In positionally fixing the magnet assembly to the stationary contact arm, a method of fastening the magnet assembly with the stationary contact arm using a retaining screw has been used in the related art.

However, the related art in which the magnetic assembly and the stationary contact arm are fastened with a retaining screw further requires a retaining screw and accompanies the process of fastening the corresponding retaining screw, thereby causing a problem of increasing the cost of the molded case circuit breaker and reducing the productivity.

SUMMARY OF THE INVENTION

Accordingly, the present disclosure is contrived to solve the foregoing problem of the related art, and an object of the present disclosure is to provide a stationary contact arm assembly for a molded case circuit breaker in which the process of fastening a retaining screw is not required to fix the magnet assembly to the stationary contact arm.

The object of the present disclosure may be accomplished by providing a stationary contact arm assembly for a molded case circuit breaker, comprising:

a current limiting type stationary contact arm having a terminal portion and a contact portion provided at both end portions thereof in the length direction, and an inclined extension portion provided between the contact portion and the terminal portion and formed to be downwardly extended in an inclined manner from the terminal portion, a flat extension portion forming a space between the flat extension portion and a bottom surface of the contact portion, a bent portion formed in a bent shape from the flat extension portion to the terminal portion;

a magnet assembly having a plurality of steel plates at least part of which is installed to be pushed into the space between the flat extension portion and contact portion in the stationary contact arm to enhance the magnetic permeability so as to increase an electromagnetic repulsive force during the current limiting operation; and an elastic support plate having an elastic support portion installed on the flat extension portion of the stationary contact arm to support the magnet assembly.

According to an aspect of the present disclosure, the flat extension portion of the stationary contact arm may be provided with a concave groove portion into which the elastic support portion is inserted.

According to another aspect of the present disclosure, the elastic support portion may include a plurality of long perforated hole portions; and a plurality of body portions formed between the perforated hole portions.

According to still another aspect of the present disclosure, the concave groove portion may be configured with a groove portion formed with a pair of first inclined surfaces formed in an inclined manner to be deep toward a central portion in the length direction and a first flat surface between the pair of first inclined surfaces, and the plurality of body portions may have a pair of second inclined surfaces formed in an inclined manner to be downwardly convex toward a central portion in the length direction in correspondence to the concave groove portions, respectively, and a second flat surface between the pair of second inclined surfaces.

According to yet still another aspect of the present disclosure, the flat extension portion of the stationary contact arm may be provided with a concave groove portion into which the elastic support portion is inserted, and the elastic support portion may include a plurality of long perforated hole portions; and a plurality of body portions formed between the perforated hole portions, wherein the plurality of body portions are formed in an inclined manner to be downwardly convex toward a central portion in the length direction, and the downwardly convex height of the body portion is greater than the groove depth of the concave groove portion.

According to still yet another aspect of the present disclosure, the stationary contact arm may include a pair of retaining screw opening portions provided to be protruded in the horizontal direction from both lateral surfaces of the flat extension portion, respectively, to allow the penetration of a retaining screw for fixing it to the molded case circuit breaker, and the elastic support plate may include a screw through opening portion for allowing the penetration of the retaining screw.

According to yet still another aspect of the present disclosure, the screw through opening portion may be configured with a long hole portion.

According to yet still another aspect of the present disclosure, the elastic support portion further comprises a pair of magnet release prevention wall portions formed to be extended as much as a predetermined height enough to prevent the transverse directional release of the magnet assembly in the vertically upward direction from both the width directional end portions of the flat elastic support plate.

According to yet still another aspect of the present disclosure, a distance between the pair of the magnet release prevention wall portions is formed to be less than by a predetermined distance or equal to the width of the magnet assembly.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
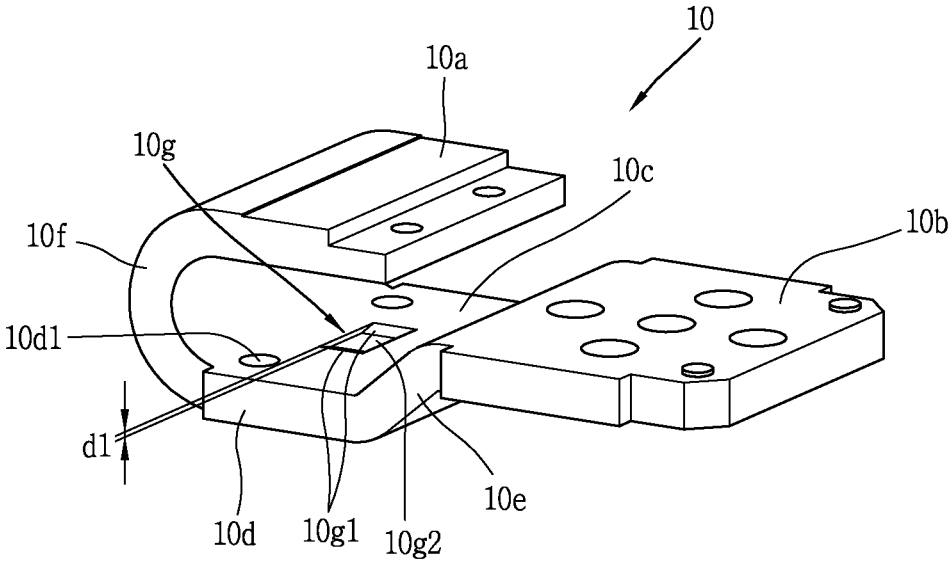
FIG. 1 is a perspective view illustrating the configuration of a stationary contact arm in a stationary contact arm assembly for a molded case circuit breaker according to a preferred embodiment of the present disclosure.
Figure 2:
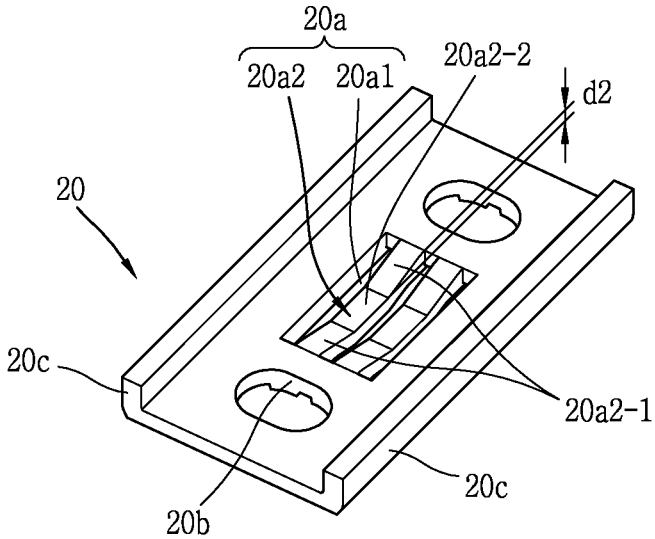
FIG. 2 is a perspective view illustrating the configuration of an elastic support plate in a stationary contact arm assembly for a molded case circuit breaker according to a preferred embodiment of the present disclosure.
Figure 3:
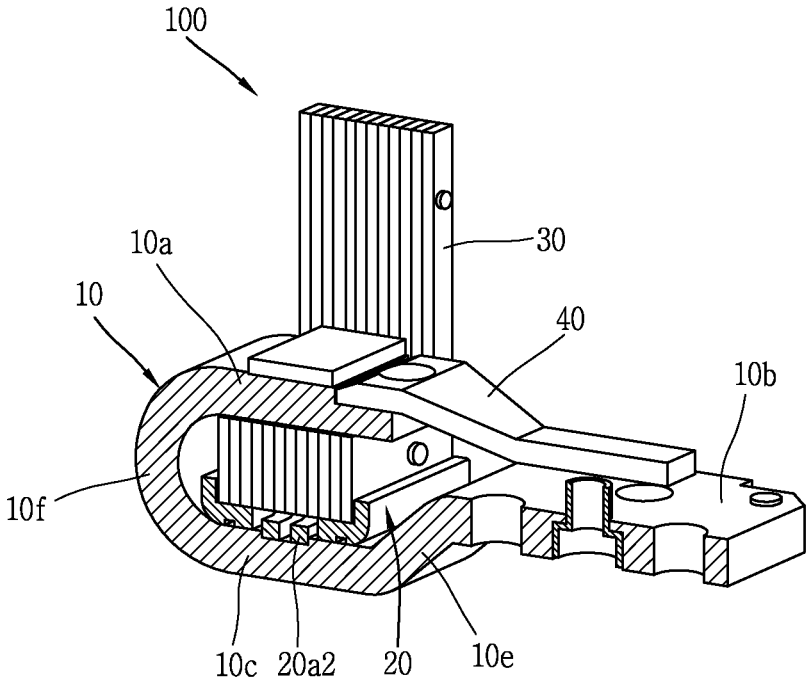
FIG. 3 is a perspective view illustrating a configuration in which a stationary contact arm assembly for a molded case circuit breaker according to a preferred embodiment of the present disclosure is assembled.

The objective of the present invention, as well as the configuration and working effect thereof to accomplish the foregoing objective will be more clearly understood by the following description for the preferred embodiments of present disclosure with reference to the accompanying drawings such as FIGS. 1 through 3.

Referring to FIG. 3, a stationary contact arm assembly 100 for a molded case circuit breaker according to a preferred embodiment of the present disclosure may include a current limiting type stationary contact arm 10, a magnet assembly 30, and an elastic support plate 20.

First, the detailed configuration of the current limiting type stationary contact arm 10 will be described with reference to FIG. 1.

The current limiting type stationary contact arm 10 has a terminal portion 10*b* and a contact portion 10*a* provided at both end portions thereof in the length direction, and has a laid down U-shaped geometric feature in which the contact portion 10*a* is bent toward the side of the terminal portion 10*b*.

The current limiting type stationary contact arm 10 may further include an inclined extension portion 10*e*, a flat extension portion 10*c*, and a bent portion 10*f*.

The inclined extension portion 10*e* is provided between the contact portion 10*a* and the terminal portion 10*b* and formed to be downwardly extended in an inclined manner from the terminal portion 10*b*.

The flat extension portion 10*c* is a portion forming a space in which the magnet assembly 30 and elastic support plate 20 can be installed between the same and a bottom surface of the contact portion 10*a*.

The bent portion 10*f* is a portion of the current limiting type stationary contact arm 10 formed in a bent shape from the flat extension portion 10*c* to the terminal portion 10*b*.

Referring to FIG. 3, the stationary contact arm assembly 100 for a molded case circuit breaker according to a preferred embodiment of the present disclosure may be provided in an extended manner from an end portion of the contact portion 10*a*, and may further include an arc runner 40 for inducing an arc.

On the other hand, referring to FIG. 3, the magnet assembly 30 is a means for enhancing the magnetic permeability to increase an electromagnetic repulsive force between the current limiting type stationary contact arm 10 and the movable contact arm (not shown) during the current limiting operation. As illustrated in the drawing, the magnet assembly 30 may be configured in such a manner that a plurality of steel plates are laminated and fastened by a fastening means such as a rivet. Here, the steel plate may be configured with an L-shaped steel plate, for instance.

The magnet assembly 30 is installed in such a manner that at least part of each steel plate is pushed into the space between the flat extension portion 10*c* and contact portion 10*a* of the current limiting type stationary contact arm 10.

The elastic support plate 20 is installed in a stationary manner on the flat extension portion 10*c* of the current limiting type stationary contact arm 10 as illustrated in FIG. 3, and the elastic support plate 20 has an elastic support portion 20*a* for supporting the magnet assembly 30 as illustrated in FIG. 3 or 2.

According to a preferred embodiment, the elastic support plate 20 may be formed of a synthetic resin plate, which is so-called plastic, having elasticity, and according to another embodiment, the elastic support plate 20 may be formed of a metal plate such as a thin steel plate having elasticity.

The flat extension portion 10*c* of the current limiting type stationary contact arm 10 may include a concave groove portion 10*g* into which the elastic support portion 20*a* is inserted as illustrated in FIG. 1, in correspondence to the elastic support portion 20*a*.

The concave groove portion 10*g* is configured with a groove portion, which is formed with a pair of first inclined surfaces 10*g*1, and a first flat surface 10*g*2.

The pair of first inclined surfaces 10*g*1 is formed in an inclined manner to be deep toward a central portion in the length direction of the concave groove portion 10*g*.

The first flat surface 10*g*2 is formed with a plane as the most bottom portion in the concave groove portion 10*g*, which is formed between a pair of first inclined surfaces.

As illustrated in FIG. 2, the elastic support portion 20*a* may include a plurality of long perforated hole portions 20*a*1, and a plurality of body portions 20*a*2 formed between a pair of perforated hole portions 20*a*1 adjacent to each other.

The plurality of body portions 20*a*2 have a pair of second inclined surfaces 20*a*2-1 formed in an inclined manner to be downwardly convex toward a central portion in the length direction in correspondence to the concave groove portions 10*g* of the stationary contact arm 10, respectively, and a second flat surface 20*a*2-2 formed between the pair of second inclined surfaces 20*a*2-1 to form the most bottom surface in the body portion 20*a*2.

The plurality of body portions 20*a*2 are formed in an inclined manner to be downwardly convex toward a central portion in the length direction, and the downwardly convex height (refer to reference character d2 in FIG. 2) of the body portion 20*a*2 is greater (higher) than the groove depth (refer to reference character d1 in FIG. 1) of the concave groove portion 10*g*.

It is expressed as the following Equation (1).

$$d2>d1 \quad (1)$$

In Equation (1), reference character d1 represents the groove depth of the concave groove portion 10*g*, and reference character d2 represents the downwardly convex height (i.e., downwardly protrusion height) of the body portion 20*a*2.

Furthermore, as illustrated in FIG. 1, the stationary contact arm 10 may include a pair of retaining screw opening portions 10*d* provided to be protruded in the horizontal direction from both lateral surfaces of the flat extension portion 10*c*, respectively, to allow the penetration of a retaining screw (not shown) for fixing the stationary contact arm 10 to the molded case circuit breaker, and each of the retaining screw opening portions 10*d* is provided with a retaining screw opening 10*d*1.

The elastic support plate 20 may include a screw through opening portion 20*b* for allowing the penetration of the retaining screw, and preferably configured with a pair of the screw through opening portions 20*b*. A distance between the pair of screw through opening portions 20*b* is predetermined as a distance enough to install a lower portion of the magnet assembly 30 therebetween. In other words, referring to FIG. 3, a distance between the pair of screw through opening portions 20*b* to a forward/backward directional width of the magnet assembly 30 is formed in a sufficiently long manner as much as the predetermined length.

According to a preferred aspect of the present disclosure, the screw through opening portion 20*b* is configured with a long hole portion.

Furthermore, the elastic support plate 20 has a pair of magnet release prevention wall portions 20*c* as illustrated in FIG. 2, and the pair of magnet release prevention wall portion 20*c* are a portion formed to be extended as much as a predetermined height enough to prevent the transverse directional release of the magnet assembly 30 in the vertically upward direction from both the width directional end portions of the flat elastic support plate 20.

A distance between the pair of the magnet release prevention wall portions 20*c* is formed to be less than by a predetermined distance or equal to the width of the magnet assembly 30 as illustrated in FIG. 3, and thus when the magnet assembly 30 is pushed between the pair of the magnet release prevention wall portions 20*c*, the pair of the magnet release prevention wall portions 20*c* becomes open wider to elastically press both the lateral surfaces of the magnet assembly 30, thereby maintaining a coupling state between the magnet assembly 30 and the elastic support plate 20.

Owing the provision of the magnet release prevention wall portion 20*c*, the longitudinal cross-sectional area of the elastic support plate 20 has a U-shape.

Next, the assembly method and working effect of a stationary contact arm assembly for a molded case circuit breaker according to a preferred embodiment of the present disclosure will be described below.

First, the assembly method of a stationary contact arm assembly for a molded case circuit breaker according to a preferred embodiment of the present disclosure will be described below.

A contact to which reference numeral is not given is attached to the contact portion 10*a* of the stationary contact arm 10 by welding as illustrated in FIG. 1.

Next, the magnet assembly 30 is installed to be pushed into between the magnet release prevention wall portions 20*c* of the elastic support plate 20, and a lower portion of the magnet assembly 30 is positioned between a pair of screw through opening portions 20*b* not to obstruct the pair of screw through opening portions 20*b*.

At this time, a distance between the pair of the magnet release prevention wall portions 20*c* is formed to be less than by a predetermined distance or equal to the width of the magnet assembly 30 as illustrated in FIG. 3, and thus when the magnet assembly 30 is pushed between the pair of the magnet release prevention wall portions 20*c*, the pair of the magnet release prevention wall portions 20*c* becomes open wider to elastically press both the lateral surfaces of the magnet assembly 30, an as a result, a coupling state between the magnet assembly 30 and the elastic support plate 20 is maintained.

Next, the process of installing the assembly of the assembled elastic support plate 20 and magnet assembly 30 on the stationary contact arm 10 will be described below.

When the elastic support portion 20*a* is pushed into the concave groove portion 10*g* of the stationary contact arm 10, the second flat surface 20*a*2-2 and second inclined surface 20*a*2-1 of the elastic support portion 20*a* moves down along the first inclined surface 10*g*1 of the concave groove portion 10*g* and the assembly of the assembled elastic support plate 20 and magnet assembly 30 is positionally fixed to the stationary contact arm 10 while the second flat surface 20*a*2-2 is mounted on the first flat surface 10*g*2. At this time, the downwardly convex height (d2) of the body portion 20*a*2 is greater (higher) than the groove depth (d1) of the concave groove portion 10*g*, and thus the body portion 20*a*2 is compressed by a height difference between the downwardly convex height (d2) of the body portion 20*a*2 and the groove depth (d1) of the concave groove portion 10*g*, and if the body portion 20*a*2 is once mounted on the concave groove portion 10*g*, then the elastic support plate 20 will be fixed by an elastically repulsive force of the body portion 20*a*2 that is going to be extended to the original downwardly convex height, thereby preventing the elastic support plate 20 from being released from the stationary contact arm 10.

Next, when the arc runner 40 is screw-fastened and fixed to an end portion of the contact portion 10*a* using a retaining screw, the assembly process of the stationary contact arm assembly as illustrated in FIG. 3 will be completed.

The assembled stationary contact arm assembly may pass through the retaining screw opening 10*d*1 provided at the retaining screw opening portion 10*d* using a retaining screw (not shown) to be fixed to an enclosure bottom surface of the molded case circuit breaker (not shown) as illustrated in FIG. 1. Here, the retaining screw may be a retaining screw for fixing the stationary contact arm assembly to the molded case circuit breaker, but not a retaining screw for fixing the magnet assembly to the stationary contact arm.

As described above, a stationary contact arm assembly for a molded case circuit breaker according to the present disclosure may include the elastic support plate 20 having the elastic support portion 20*a* supporting the magnet assembly 30, and thus a retaining screw for fixing the magnet assembly 30 to the stationary contact arm may be not required to reduce the cost due to the retaining screw, and the process of fastening the retaining screw may be not required to enhance the productivity.

In a stationary contact arm assembly for a molded case circuit breaker according to the present disclosure, the stationary contact arm 10 may be provided with the concave groove portion 10*g* into which the elastic support portion 20*a* is inserted, thereby allowing the installation of the elastic support plate 20 to be easily completed by inserting the elastic support portion 20*a* of the elastic support plate 20 into the concave groove portion 10*g* of the stationary contact arm.

In a stationary contact arm assembly for a molded case circuit breaker according to the present disclosure, the elastic support portion 20*a* may have a configuration in which the elastic support portion 20*a* includes the plurality of long perforated hole portions 20*a*1 and a plurality of body portions 20*a*2 formed between the long perforated hole portions 20*a*1 and thus the elastic support plate 20 itself supports the magnet assembly 30 by an elastic force, and accordingly, the elastic support plate 20 may support the magnet assembly 30 with its own elastic force with no additional constituent elements such as springs to provide simple constituent components, thereby reducing the production cost as well as facilitating the production process.

In a stationary contact arm assembly for a molded case circuit breaker according to the present disclosure, the concave groove portion 10*g* may be configured with a groove portion formed with a pair of first inclined surfaces 10*g*1 formed in an inclined manner to be deep toward a central portion in the length direction and a first flat surface 10*g*2 between the pair of first inclined surfaces 10*g*1, and the plurality of body portions 20*a*2 may have a pair of second inclined surfaces 20*a*2-1 formed in an inclined manner to be downwardly convex toward a central portion in the length direction in correspondence to the concave groove portions 10*g*, and a second flat surface 20*a*2-2 between the pair of second inclined surfaces 20*a*2-1, thereby allowing the second flat surface 20*a*2-1 and second inclined surface 20*a*2-1 to be efficiently guided along the first inclined surface 10*g*1 while installing the elastic support plate 20 on the stationary contact arm 10 as well as allowing the elastic support plate 20 to be securely fixed to the stationary contact arm 10 when the second flat surface 20*a*2-2 is mounted on the first flat surface 10*g*2 to prevent the elastic support plate 20 from being released from the stationary contact arm 10.

In a stationary contact arm assembly for a molded case circuit breaker according to the present disclosure, the downwardly convex height (d2) of the body portion 20*a*2 may be greater (higher) than the groove depth (d1) of the concave groove portion 10*g*, and thus the body portion 20*a*2 may be compressed by a height difference between the downwardly convex height (d2) of the body portion 20*a*2 and the groove depth (d1) of the concave groove portion 10*g*, and if the body portion 20*a*2 is once mounted on the concave groove portion 10*g*, then the elastic support plate 20 will be fixed by an elastically repulsive force of the body portion 20*a*2 that is going to be extended to the original downwardly convex height, thereby preventing the elastic support plate 20 from being released from the stationary contact arm 10.

In a stationary contact arm assembly for a molded case circuit breaker according to the present disclosure, the stationary contact arm 10 may include a pair of retaining screw opening portions 10*d* provided to be protruded in the horizontal direction from both lateral surfaces of the flat extension portion 10*c*, respectively, to allow the penetration of a retaining screw for fixing it to the molded case circuit breaker, and the elastic support plate 20 may include a screw through opening portion 20*b* for allowing the penetration of the retaining screw, and thus the retaining screw may be fixed to an enclosure bottom surface of the molded case circuit breaker the retaining screw opening 10*d*1 of the retaining screw opening portion 10*d* and the screw through opening portion 20*b*, thereby obtaining an effect of allowing the stationary contact arm 10 to be positionally fixed thereto in a secure manner.

In a stationary contact arm assembly for a molded case circuit breaker according to the present disclosure, the screw through opening portion 20*b* may be configured with a long hole portion, thereby allowing the penetration of a retaining screw in a flexible manner within the length of the long hole even when the retaining screw opening portion 10*d* and screw through opening portion 20*b* are not formed on a straight line.

What is claimed is:

1. A stationary contact arm assembly for a molded case circuit breaker, the stationary contact arm assembly comprising:

a current limiting type stationary contact arm comprising a terminal portion at a first lengthwise end and a contact portion at a second lengthwise end;

an inclined extension portion provided between the contact portion and the terminal portion, the inclined extension portion downwardly inclined from the terminal portion;

a flat extension portion vertically spaced apart from a bottom surface of the contact portion such that a space is formed between the flat extension portion and the bottom surface of the contact portion;

a bent portion formed in a bent shape from the flat extension portion to the contact portion;

a magnet assembly comprising a plurality of steel plates, at least part of the magnet assembly installed in the space between the flat extension portion and the contact portion in order to enhance magnetic permeability and increase an electromagnetic repulsive force during a current limiting operation; and an elastic support plate installed on the flat extension portion and comprising an elastic support portion in order to support the magnet assembly, the elastic support portion comprising a plurality of long perforated hole portions and a plurality of body portions formed between the plurality of long perforated hole portions.

2. The stationary contact arm assembly of claim 1, wherein the flat extension portion comprises a concave groove portion into which the elastic support portion is inserted.

3. The stationary contact arm assembly of claim 2, wherein:

the concave groove portion comprises a pair of first inclined surfaces and a first flat surface between the pair of first inclined surfaces, the pair of first inclined surfaces inclined toward a central portion of the concave groove portion in the lengthwise direction; and the elastic support portion corresponds to the concave groove portion and comprises a pair of second inclined surfaces and a second flat surface between the pair of second inclined surfaces, the pair of second inclined surfaces inclined such that they are downwardly convex toward the central portion in the lengthwise direction.

4. The stationary contact arm assembly of claim 2, wherein:

the plurality of body portions are inclined downwardly such that they are convex toward a central portion of the concave groove portion in the lengthwise direction; and a downwardly convex height of the plurality of body portions is greater than a depth of the concave groove portion.

5. The stationary contact arm assembly of claim 1, wherein:

the stationary contact arm further comprises a pair of retaining screw opening portions, each of the pair of retaining screw opening portions protruding in a horizontal direction from one of a pair of lateral surfaces of the flat extension portion in order to facilitate penetration of a retaining screw for fixing the stationary contact arm to the molded case circuit breaker; and the elastic support plate further comprises an opening to allow penetration of the retaining screw.

6. The stationary contact arm of claim 5, wherein the opening comprises a long hole portion.

7. The stationary contact arm assembly of claim 1, wherein the elastic support portion further comprises a pair of magnet release prevention wall portions configured to extend as much as a predetermined height in a vertically upward direction from two width directional end portions of the elastic support plate in order to prevent transverse directional release of the magnet assembly.

8. The stationary contact arm assembly of claim 7, wherein a distance between the pair of magnet release prevention wall portions is equal to or less than a width of the magnet assembly by a predetermined amount.

* * * * *